US010265823B2

(12) United States Patent
Xue et al.

(10) Patent No.: US 10,265,823 B2
(45) Date of Patent: Apr. 23, 2019

(54) MULTI-STATION WHEEL BURR REMOVING DEVICE

(71) Applicant: CITIC Dicastal CO., LTD, Qinhuangdao (CN)

(72) Inventors: Bowen Xue, Qinhuangdao (CN); Haiyi Wang, Qinhuangdao (CN); Huayou Li, Qinhuangdao (CN); Jiandong Guo, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 0 days.

(21) Appl. No.: 15/694,043

(22) Filed: Sep. 1, 2017

(65) Prior Publication Data

US 2018/0333819 A1 Nov. 22, 2018

(30) Foreign Application Priority Data

May 19, 2017 (CN) ..... 2017 1 0356999

(51) Int. Cl.

| | |
|---|---|
| ***B24B 5/44*** | (2006.01) |
| ***B24B 47/10*** | (2006.01) |
| ***B24B 41/06*** | (2012.01) |
| ***B24B 9/04*** | (2006.01) |
| ***B24B 19/28*** | (2006.01) |
| ***B24B 5/06*** | (2006.01) |

(52) U.S. Cl.

CPC ..... *B24B 5/44* (2013.01); *B24B 5/065* (2013.01); *B24B 9/04* (2013.01); *B24B 19/28* (2013.01); *B24B 41/06* (2013.01); *B24B 47/10* (2013.01)

(58) Field of Classification Search

CPC .. B24B 5/04; B24B 5/065; B24B 5/44; B24B 9/005; B24B 9/02; B24B 9/04; B24B 19/00; B24B 19/28; B24B 41/06; B24B 47/10; B24B 47/12

USPC ..... 451/132, 194, 195, 231

See application file for complete search history.

(56) References Cited

U.S. PATENT DOCUMENTS 3,258,804 A * 7/1966 Fowle ..... B24B 5/225 15/104.011

4,216,560 A * 8/1980 Schmidt ..... B24B 41/06 15/268

(Continued)

FOREIGN PATENT DOCUMENTS

JP 3044289 B2 * 5/2000

JP 3091417 B2 * 9/2000

*Primary Examiner* — Eileen P Morgan

(74) *Attorney, Agent, or Firm* — Calfee, Halter & Griswold LLP

(57) ABSTRACT

The application discloses a multi-station wheel burr removing device, includes lifting translation systems, a clamping drive system and grinding systems. In practical use, the four V-shaped rollers clamp a wheel, a sixth servo motor and the first electric servo cylinder respectively adjusts the angle and the position of the rolling brush, and when the rolling brush contacts the edge of a wheel flange, burrs can be removed; the fifth servo motor and the sixth servo motor respectively adjusts the position and the angle of the lower grinding head, and when the lower grinding head contacts a wheel valve hole, burrs below can be removed; the third servo motor and the second electric servo cylinder respectively adjusts the angle and the position of the upper grinding head, when the upper grinding head contacts the wheel valve hole, burrs can be removed.

1 Claim, 3 Drawing Sheets

(56) References Cited

U.S. PATENT DOCUMENTS

2013/0102233 A1* 4/2013 Cheon ..... B24B 27/033
451/331
2014/0194038 A1* 7/2014 Lowe ..... B24B 9/04
451/11

* cited by examiner

MULTI-STATION WHEEL BURR REMOVING DEVICE

CROSS-REFERENCE TO RELATED APPLICATIONS

This application claims priority to Chinese Patent Application No. 2017103569997, filed on May 19, 2017, which is hereby incorporated by reference in its entirety.

TECHNICAL FIELD

The present application relates to a wheel surface treatment device, and specifically, to a wheel burr removing device.

BACKGROUND ART

In the machining production process of an aluminum alloy wheel, a flange is machined on a lathe, burrs may be produced at the edge of the machined flange, and the burrs are removed by an operator holding a burr removing knife in the traditional manner, so that the efficiency is very low and the method does not adapt to large-batch production at all. Furthermore, a wheel valve hole is formed by drilling, and burrs are also produced at its edge and removed manually, so that time and labor are wasted. Based on said two points, special burr removing equipment for the two positions has been studying all the time in the wheel industry.

SUMMARY OF THE INVENTION

The present application is aimed at providing a multi-station wheel bur removing device, which can be used for not only removing burrs at the edge of a wheel flange, but also removing burrs at a wheel valve hole.

To fulfill the above aim, the present application adopts the following technical solution: a multi-station wheel burr removing device comprises a frame, first cylinders, lower guide posts, lower guide sleeves, a lower fixed plate, a lower lifting plate, a first guide rail, a lower sliding plate, a vertical plate, a first electric servo cylinder, a first servo motor, an upper fixed plate, a second guide rail, a left sliding plate, left bearing seats, left shafts, V-shaped rollers, a second cylinder, an upper grinding head, an upper shaft, an upper bearing seat, a first belt pulley, a first synchronous belt, a second belt pulley, a second servo motor, an upturning plate, a third servo motor, a sliding rack, a third guide rail, an upper lifting plate, upper guide posts, upper guide sleeves, third cylinders, a second electric servo cylinder, a rolling brush, a fourth servo motor, a third belt pulley, a second synchronous belt, a first rotating shaft, a fourth belt pulley, a lower grinding head, a down-turning plate, a second rotating shaft, a turnover bearing seat, a turnover rack, a fifth servo motor, right shafts, right bearing seats, a sixth servo motor, a third rotating shaft and a fourth rotating shaft.

A lower lifting translation system comprises: the four lower guide sleeves are fixed on the lower fixed plate; the four lower guide posts are matched with the lower guide sleeves, and are fixed below the lower lifting plate; the two first cylinders are fixed below the lower fixed plate, and the output ends of the first cylinders are articulated with the lower part of the lower lifting plate; the lower sliding plate is mounted above the lower lifting plate via the first guide rail; the first electric servo cylinder is fixed above the lower lifting plate, and the output end of the first electric servo cylinder is connected with the lower sliding plate.

A clamping drive system comprises: the left sliding plate is mounted above the upper fixed plate via the second guide rail; the two left bearing seats are fixed above the left sliding plate; the left shafts are mounted in the left bearing seats via bearings; the V-shaped rollers are fixed above the left shafts; the first servo motor is fixed below the left sliding plate, and the output end of the first servo motor is connected with one of the left shafts; the second cylinder is fixed on the upper fixed plate, and the output end of the second cylinder is connected with the left sliding plate; the right bearing seats are fixed above the upper fixed plate, and the two right shafts are mounted inside the right bearing seats via bearings; and the V-shaped rollers are fixed above the right shafts.

An upper grinding system comprises: the upper bearing seat is fixed on a flat plate of the upturning plate; the upper shaft is mounted inside the upper bearing seat via a bearing; the upper grinding head is fixed below the upper shaft; the second belt pulley is fixed above the upper shaft; the second servo motor is fixed above the flat plate of the upturning plate, and the first belt pulley is fixed at the output end of the second servo motor; the first belt pulley is connected with the second belt pulley via the first synchronous belt; the third servo motor is fixed on the side of the sliding rack; the upturning plate is connected with the sliding rack via the third rotating shaft; and the output end of the third servo motor is connected with one end of the third rotating shaft.

An upper lifting translation system comprises: the four upper guide sleeves are fixed above a top plate of the frame; four upper guide posts are matched with the upper guide sleeves, and are fixed above the upper lifting plate; the third cylinders are also fixed above the top plate of the frame, and the output ends of the third cylinders are articulated with the upper part of the upper lifting plate; the top of the sliding rack is mounted below the upper lifting plate via the third guide rail; the second electric servo cylinder is fixed at one end below the upper lifting plate, and the output end of the second electric servo cylinder is connected with the sliding rack.

A lower grinding system comprises: the first rotating shaft is mounted at one end of the down-turning plate via a bearing; the lower grinding head is fixed below the first rotating shaft, and the rolling brush is fixed above the first rotating shaft; the third belt pulley is also fixed above the first rotating shaft; the fourth servo motor is fixed above the down-turning plate, and the fourth belt pulley is fixed at the output end of the fourth servo motor; the third belt pulley is connected with the fourth belt pulley via the second synchronous belt; the turnover bearing seat is fixed on the turnover rack, and the second rotating shaft is mounted inside the turnover bearing seat via a bearing; the left end of the down-turning plate is connected with the right end of the second rotating shaft; the fifth servo motor is fixed on the left of the turnover rack, and the output end of the fifth servo motor is connected with the second rotating shaft; the turnover rack is connected with the upper end of the vertical plate via the fourth rotating shaft; the sixth servo motor is fixed on the side of the upper part of the vertical plate, and the output end of the sixth servo motor is connected with one end of the fourth rotating shaft.

In practical use, the second cylinder drives the left sliding plate to move right via the second guide rail so that the four V-shaped rollers clamp a wheel, and the first servo motor drives the clamped wheel to rotate; the sixth servo motor adjusts the angle of the rolling brush, the first electric servo cylinder adjusts the position of the rolling brush via the first guide rail, and the fourth servo motor drives the rolling brush to rotate; the first cylinders drive the rolling brush to ascend via the lower guide posts, and when the rolling brush contacts the edge of a wheel flange, burrs therein can be uniformly removed; the fifth servo motor adjusts the position of the lower grinding head via the second rotating shaft, the sixth servo motor adjusts the angle of the lower grinding head, the first electric servo cylinder adjusts the horizontal position of the lower grinding head via the first guide rail, the first cylinders drive the lower grinding head to ascend via the lower guide posts, and when the lower grinding head contacts a wheel valve hole, burrs below can be removed; the second servo motor drives the upper grinding head to rotate, the third servo motor adjusts the angle of the upper grinding head, the second electric servo cylinder adjusts the position of the upper grinding head via the third guide rail, the third cylinders drive the upper grinding head to descend via the upper guide posts, and when the upper grinding head contacts the wheel valve hole, burrs thereon can be removed.

The multi-station wheel burr removing device of the present application may be used for not only removing burrs at the edge of the wheel flange, but also removing burrs at the wheel valve hole, so the production efficiency is very high; and simultaneously, the device has the characteristics of high automation degree, advanced process, strong generality and high safety and stability.

Figure 1:
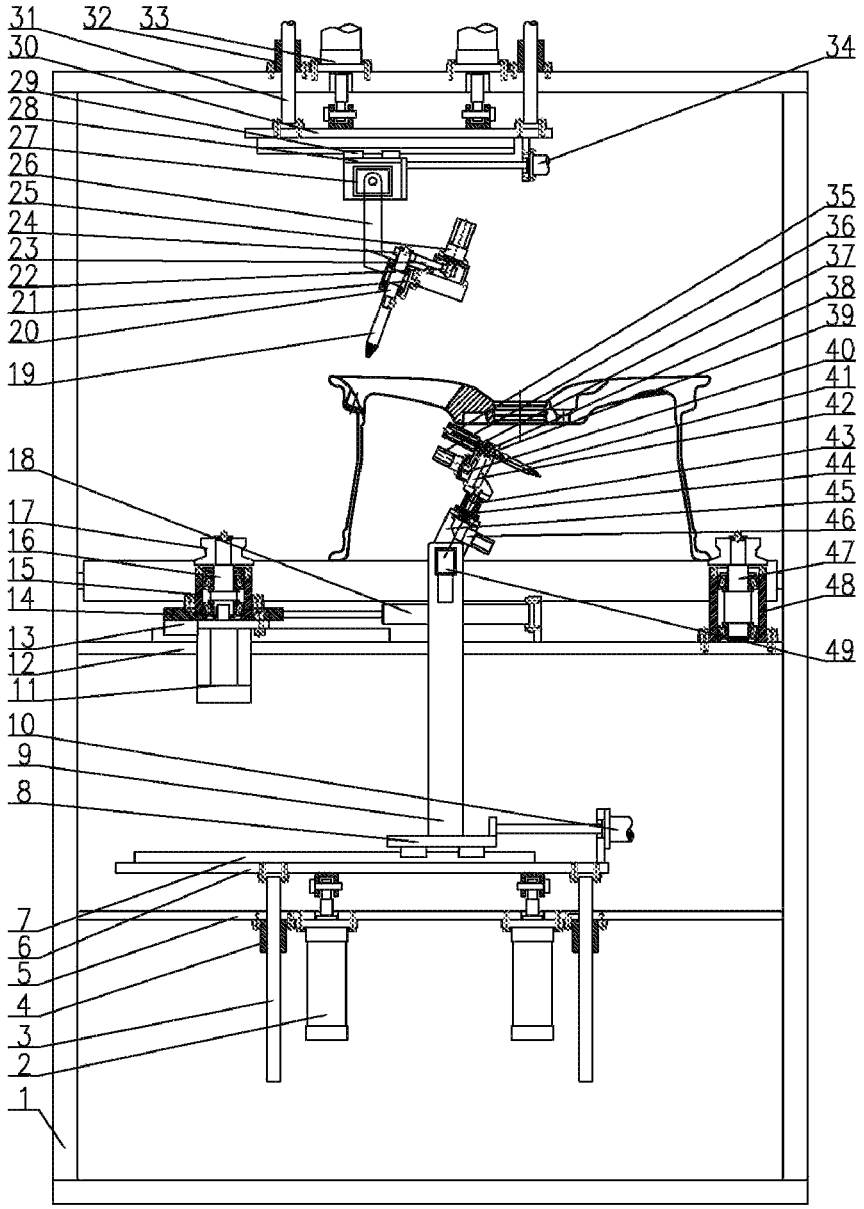
FIG. 1 is a front view of a multi-station wheel bur removing device of the present application when burrs at the edge of a flange are removed.
Figure 2:
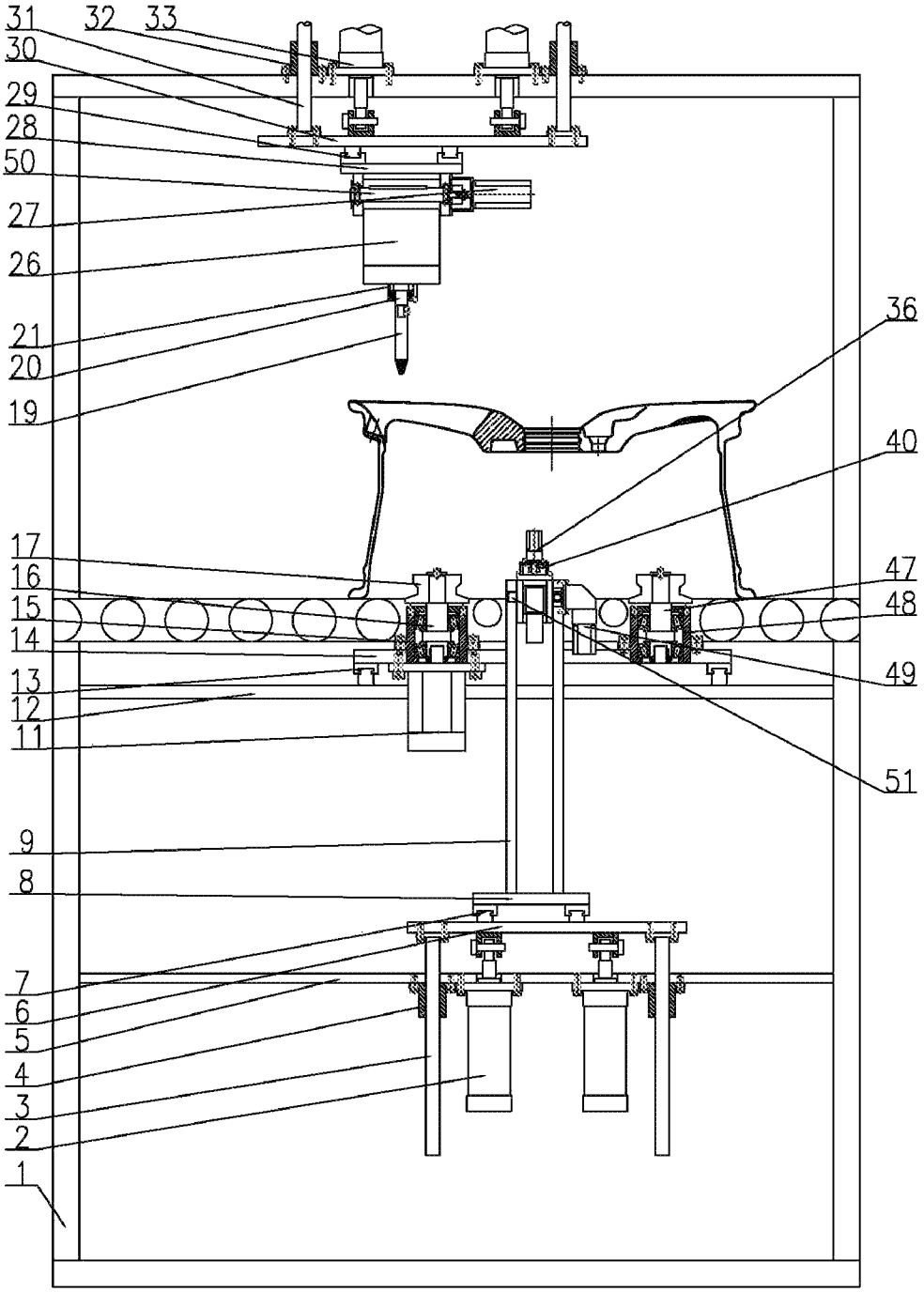
FIG. 2 is a left view of the multi-station wheel bur removing device of the present application when burrs at the edge of the flange are removed.
Figure 3:
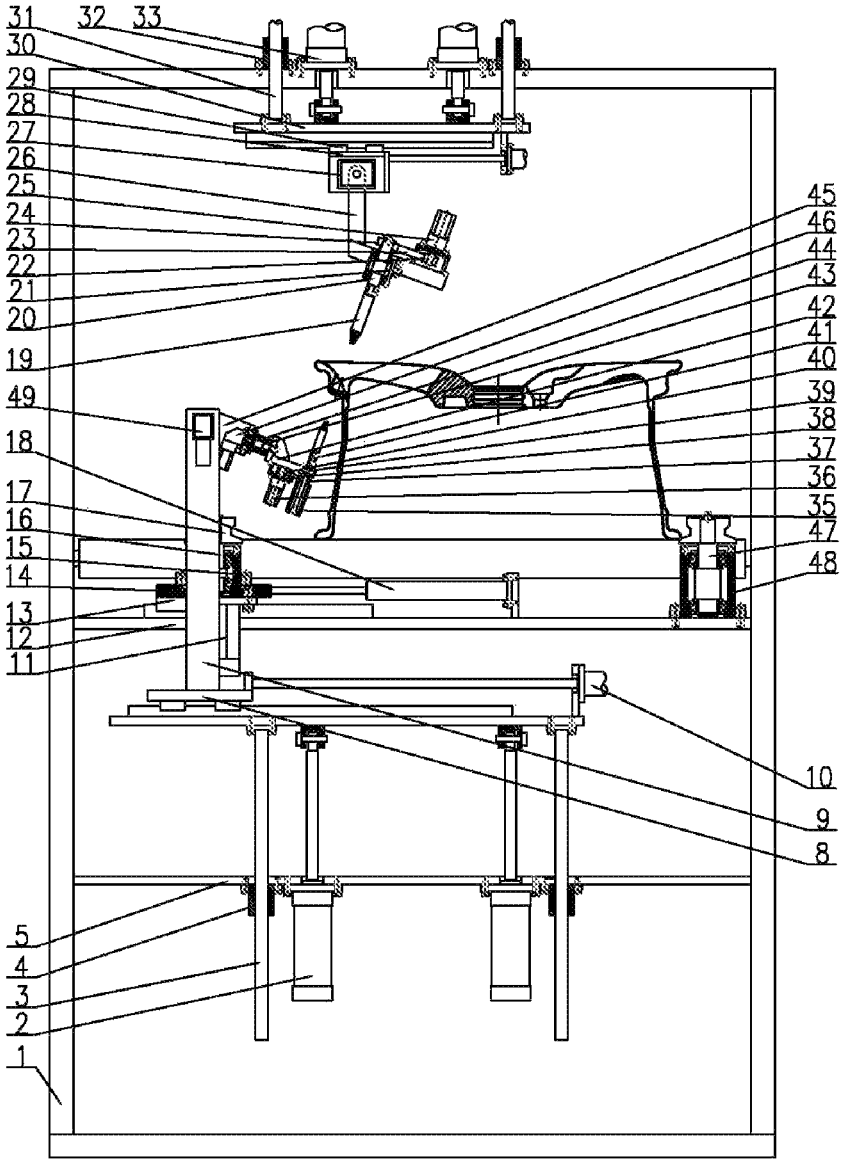
FIG. 3 is a front view of the multi-station wheel bur removing device of the present application when burrs at the edge of a valve hole are removed.

In which: 1—frame, 2—first cylinder, 3—lower guide post, 4—lower guide sleeve, 5—lower fixed plate, 6—lower lifting plate, 7—first guide rail, 8—lower sliding plate, 9—vertical plate, 10—first electric servo cylinder, 11—first servo motor, 12—upper fixed plate, 13—second guide rail, 14—left sliding plate, 15—left bearing seat, 16—left shaft, 17—V-shaped roller, 18—second cylinder, 19—upper grinding head, 20—upper shaft, 21—upper bearing seat, 22—first belt pulley, 23—first synchronous belt, 24—second belt pulley, 25—second servo motor, 26—upturning plate, 27—third servo motor, 28—sliding rack, 29—third guide rail, 30—upper lifting plate, 31—upper guide post, 32—upper guide sleeve, 33—third cylinder, 34—second electric servo cylinder, 35—rolling brush, 36—fourth servo motor, 37—third belt pulley, 38—second synchronous belt, 39—first rotating shaft, 40—fourth belt pulley, 41—lower grinding head, 42—down-turning plate, 43—second rotating shaft, 44—turnover bearing seat, 45—turnover rack, 46—fifth servo motor, 47—right shaft, 48—right bearing seat, 49—sixth servo motor, 50—third rotating shaft, 51—fourth rotating shaft.

DETAILED DESCRIPTION OF THE INVENTION

The details and working conditions of the specific device provided by the present application will be described in combination with the accompanying drawings.

The device comprises a frame 1, first cylinders 2, lower guide posts 3, lower guide sleeves 4, a lower fixed plate 5, a lower lifting plate 6, a first guide rail 7, a lower sliding plate 8, a vertical plate 9, a first electric servo cylinder 10, a first servo motor 11, an upper fixed plate 12, a second guide rail 13, a left sliding plate 14, left bearing seats 15, left shafts 16, V-shaped rollers 17, a second cylinder 18, an upper grinding head 19, an upper shaft 20, an upper bearing seat 21, a first belt pulley 22, a first synchronous belt 23, a second belt pulley 24, a second servo motor 25, an upturning plate 26, a third servo motor 27, a sliding rack 28, a third guide rail 29, an upper lifting plate 30, upper guide posts 31, upper guide sleeves 32, third cylinders 33, a second electric servo cylinder 34, a rolling brush 35, a fourth servo motor 36, a third belt pulley 37, a second synchronous belt 38, a first rotating shaft 39, a fourth belt pulley 40, a lower grinding head 41, a down-turning plate 42, a second rotating shaft 43, a turnover bearing seat 44, a turnover rack 45, a fifth servo motor 46, right shafts 47, right bearing seats 48, a sixth servo motor 49, a third rotating shaft 50 and a fourth rotating shaft 51.

A lower lifting translation system comprises: the four lower guide sleeves 4 are fixed on the lower fixed plate 5, and the four lower guide posts 3 are matched with the lower guide sleeves 4, and are fixed below the lower lifting plate 6; the two first cylinders 2 are fixed below the lower fixed plate 5, and the output ends of the first cylinders 2 are articulated with the lower part of the lower lifting plate 6; the lower sliding plate 8 is mounted above the lower lifting plate 6 via the first guide rail 7; the first electric servo cylinder 10 is fixed above the lower lifting plate 6, and the output end of the first electric servo cylinder 10 is connected with the lower sliding plate 8.

A clamping drive system comprises: the left sliding plate 14 is mounted above the upper fixed plate 12 via the second guide rail 13; the two left bearing seats 15 are fixed on the left sliding plate 14; the left shafts 16 are mounted in the left bearing seats 15 via bearings; the V-shaped rollers 17 are fixed above the left shafts 16; the first servo motor 11 is fixed below the left sliding plate 14, and the output end of the first servo motor 11 is connected with one of the left shafts 16; the second cylinder 18 is fixed on the upper fixed plate 12, and the output end of the second cylinder 18 is connected with the left sliding plate 14; the right bearing seats 48 are fixed above the upper fixed plate 12, and the two right shafts 47 are mounted inside the right bearing seats 48 via bearings; and the V-shaped rollers 17 are fixed above the right shafts 47.

An upper grinding system comprises: the upper bearing seat 21 is fixed on a flat plate of the upturning plate 26; the upper shaft 20 is mounted inside the upper bearing seat 21 via a bearing; the upper grinding head 19 is fixed below the upper shaft 20; the second belt pulley 24 is fixed above the upper shaft 20; the second servo motor 25 is fixed above the flat plate of the upturning plate 26, and the first belt pulley 22 is fixed at the output end of the second servo motor 25; the first belt pulley 22 is connected with the second belt pulley 24 via the first synchronous belt 23; the third servo motor 27 is fixed on the side of the sliding rack 28; the upturning plate 26 is connected with the sliding rack 28 via the third rotating shaft 50; and the output end of the third servo motor 27 is connected with one end of the third rotating shaft 50.

An upper lifting translation system comprises: the four upper guide sleeves 32 are fixed above a top plate of the frame 1; the four upper guide posts 31 are matched with the upper guide sleeves 32, and are fixed above the upper lifting plate 30; the third cylinders 33 are also fixed above the top plate of the frame 1, and the output ends of the third cylinders 33 are articulated with the upper part of the upper lifting plate 30; the top of the sliding rack 28 is mounted below the upper lifting plate 30 via the third guide rail 29; the second electric servo cylinder 34 is fixed at one end below the upper lifting plate 30, and the output end of the second electric servo cylinder 34 is connected with the sliding rack 28.

A lower grinding system comprises: the first rotating shaft 39 is mounted at one end of the down-turning plate 42 via a bearing; the lower grinding head 41 is fixed below the first rotating shaft 39, and the rolling brush 35 is fixed above the first rotating shaft 39; the third belt pulley 37 is also fixed above the first rotating shaft 39; the fourth servo motor 36 is fixed above the down-turning plate 42, and the fourth belt pulley 40 is fixed at the output end of the fourth servo motor 36; the third belt pulley 37 is connected with the fourth belt pulley 40 via the second synchronous belt 38; the turnover bearing seat 44 is fixed on the turnover rack 45, and the second rotating shaft 43 is mounted inside the turnover bearing seat 44 via a bearing; the left end of the down-turning plate 42 is connected with the right end of the second rotating shaft 43; the fifth servo motor 46 is fixed on the left of the turnover rack 45, and the output end of the fifth servo motor 46 is connected with the second rotating shaft 43; the turnover rack 45 is connected with the upper end of the vertical plate 9 via the fourth rotating shaft 51; the sixth servo motor 49 is fixed on the side of the upper part of the vertical plate 9, and the output end of the sixth servo motor 49 is connected with one end of the fourth rotating shaft 51.

In the working process, the second cylinder 18 drives the left sliding plate 14 to move right via the second guide rail 13 so that the four V-shaped rollers 17 clamp a wheel, and the first servo motor 11 drives the clamped wheel to rotate; the sixth servo motor 49 adjusts the angle of the rolling brush 35, the first electric servo cylinder 10 adjusts the position of the rolling brush 35 via the first guide rail 7, and the fourth servo motor 36 drives the rolling brush 35 to rotate; the first cylinders 2 drive the rolling brush 35 to ascend via the lower guide posts 3, and when the rolling brush 35 contacts the edge of a wheel flange, burrs therein can be uniformly removed; the fifth servo motor 46 adjusts the position of the lower grinding head 41 via the second rotating shaft 43, the sixth servo motor 49 adjusts the angle of the lower grinding head 41, the first electric servo cylinder 10 adjusts the horizontal position of the lower grinding head 41 via the first guide rail 7, the first cylinders 2 drive the lower grinding head 41 to ascend via the lower guide posts 3, and when the lower grinding head 41 contacts a wheel valve hole, burrs below can be removed; the second servo motor 25 drives the upper grinding head 19 to rotate, the third servo motor 27 adjusts the angle of the upper grinding head 19, the second electric servo cylinder 34 adjusts the position of the upper grinding head 19 via the third guide rail 29, the third cylinders 33 drive the upper grinding head 19 to descend via the upper guide posts 31, and when the upper grinding head 19 contacts the wheel valve hole, burrs thereon can be removed.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A multi-station wheel burr removing device, comprising a frame, first cylinders, lower guide posts, lower guide sleeves, a lower fixed plate, a lower lifting plate, a first guide rail, a lower sliding plate, a vertical plate, a first electric servo cylinder, a first servo motor, an upper fixed plate, a second guide rail, a left sliding plate, left bearing seats, left shafts, V-shaped rollers, a second cylinder, an upper grinding head, an upper shaft, an upper bearing seat, a first belt pulley, a first synchronous belt, a second belt pulley, a second servo motor, an upturning plate, a third servo motor, a sliding rack, a third guide rail, an upper lifting plate, upper guide posts, upper guide sleeves, third cylinders, a second electric servo cylinder, a rolling brush, a fourth servo motor, a third belt pulley, a second synchronous belt, a first rotating shaft, a fourth belt pulley, a lower grinding head, a down-turning plate, a second rotating shaft, a turnover bearing seat, a turnover rack, a fifth servo motor, right shafts, right bearing seats, a sixth servo motor, a third rotating shaft and a fourth rotating shaft, wherein a lower lifting translation system comprises: the four lower guide sleeves are fixed on the lower fixed plate, and the four lower guide posts are matched with the lower guide sleeves, and are fixed below the lower lifting plate; the two first cylinders are fixed below the lower fixed plate, and the output ends of the first cylinders are articulated with the lower part of the lower lifting plate; the lower sliding plate is mounted above the lower lifting plate via the first guide rail; the first electric servo cylinder is fixed above the lower lifting plate, and the output end of the first electric servo cylinder is connected with the lower sliding plate;

a clamping drive system comprises: the left sliding plate is mounted above the upper fixed plate via the second guide rail; the two left bearing seats are fixed above the left sliding plate; the left shafts are mounted in the left bearing seats via bearings; the V-shaped rollers are fixed above the left shafts; the first servo motor is fixed below the left sliding plate, and the output end of the first servo motor is connected with one of the left shafts; the second cylinder is fixed on the upper fixed plate, and the output end of the second cylinder is connected with the left sliding plate; the right bearing seats are fixed above the upper fixed plate, and the two right shafts are mounted inside the right bearing seats via bearings; the V-shaped rollers are fixed above the right shafts;

an upper grinding system comprises: the upper bearing seat is fixed on a flat plate of the upturning plate; the upper shaft is mounted inside the upper bearing seat via a bearing; the upper grinding head is fixed below the upper shaft; the second belt pulley is fixed above the upper shaft; the second servo motor is fixed above the flat plate of the upturning plate, and the first belt pulley is fixed at the output end of the second servo motor; the first belt pulley is connected with the second belt pulley via the first synchronous belt; the third servo motor is fixed on the side of the sliding rack; the upturning plate is connected with the sliding rack via the third rotating shaft; the output end of the third servo motor is connected with one end of the third rotating shaft;

an upper lifting translation system comprises: the four upper guide sleeves are fixed above a top plate of the frame; the four upper guide posts are matched with the upper guide sleeves, and are fixed above the upper lifting plate; the third cylinders are also fixed above the top plate of the frame, and the output ends of the third cylinders are articulated with the upper part of the upper lifting plate; the top of the sliding rack is mounted below the upper lifting plate via the third guide rail; the second electric servo cylinder is fixed at one end below the upper lifting plate, and the output end of the second electric servo cylinder is connected with the sliding rack;

a lower grinding system comprises: the first rotating shaft is mounted at one end of the down-turning plate via a bearing; the lower grinding head is fixed below the first rotating shaft, and the rolling brush is fixed above the first rotating shaft; the third belt pulley is also fixed above the first rotating shaft; the fourth servo motor is fixed above the down-turning plate, and the fourth belt pulley is fixed at the output end of the fourth servo motor; the third belt pulley is connected with the fourth belt pulley via the second synchronous belt; the turnover bearing seat is fixed on the turnover rack, and the second rotating shaft is mounted inside the turnover bearing seat via a bearing; the left end of the down-turning plate is connected with the right end of the second rotating shaft; the fifth servo motor is fixed on the left of the turnover rack, and the output end of the fifth servo motor is connected with the second rotating shaft; the turnover rack is connected with the upper end of the vertical plate via the fourth rotating shaft; the sixth servo motor is fixed on the side of the upper part of the vertical plate, and the output end of the sixth servo motor is connected with one end of the fourth rotating shaft;

in practical use, the second cylinder drives the left sliding plate to move right via the second guide rail so that the four V-shaped rollers clamp a wheel, and the first servo motor drives the clamped wheel to rotate; the sixth servo motor adjusts the angle of the rolling brush, the first electric servo cylinder adjusts the position of the rolling brush via the first guide rail, and the fourth servo motor drives the rolling brush to rotate; the first cylinders drive the rolling brush to ascend via the lower guide posts, and when the rolling brush contacts the edge of a wheel flange, burrs therein can be uniformly removed; the fifth servo motor adjusts the position of the lower grinding head via the second rotating shaft, the sixth servo motor adjusts the angle of the lower grinding head, the first electric servo cylinder adjusts the horizontal position of the lower grinding head via the first guide rail, the first cylinders drive the lower grinding head to ascend via the lower guide posts, and when the lower grinding head contacts a wheel valve hole, burrs below can be removed; the second servo motor drives the upper grinding head to rotate, the third servo motor adjusts the angle of the upper grinding head, the second electric servo cylinder adjusts the position of the upper grinding head via the third guide rail, the third cylinders drive the upper grinding head to descend via the upper guide posts, and when the upper grinding head contacts the wheel valve hole, burrs thereon can be removed.

* * * * *